US009854920B1

(12) United States Patent
Welborn et al.

(10) Patent No.: US 9,854,920 B1
(45) Date of Patent: Jan. 2, 2018

(54) BEDSHEET ANCHOR SYSTEM

(71) Applicants: Steven Welborn, Deltona, FL (US); Melanie Welborn, Deltona, FL (US)

(72) Inventors: Steven Welborn, Deltona, FL (US); Melanie Welborn, Deltona, FL (US)

( * ) Notice: Subject to any disclaimer, the term of this patent is extended or adjusted under 35 U.S.C. 154(b) by 0 days.

(21) Appl. No.: 15/603,617

(22) Filed: May 24, 2017

(51) Int. Cl.
*A47C 21/00* (2006.01)
*A47C 21/02* (2006.01)

(52) U.S. Cl.
CPC ..... *A47C 21/022* (2013.01)

(58) Field of Classification Search
CPC ..... A47C 21/022
See application file for complete search history.

(56) References Cited

U.S. PATENT DOCUMENTS 5,218,729 A 6/1993 Walton
8,321,975 B1 12/2012 Lindberg et al.
9,237,813 B2 1/2016 Dubois

*Primary Examiner* — Robert Sandy
*Assistant Examiner* — David M Upchurch
(74) *Attorney, Agent, or Firm* — Stevenson IP, LLC

(57) ABSTRACT

A bedsheet anchor system including a triangular flat base having a pair of legs, a curved hypotenus leg, a top surface area, and a bottom surface area. The bottom surface area of the triangular flat base has a strab knob. Each of a pair of triangular planar members has a bottom leg, a side leg, a curved leg, an interior area, a lower exterior area, and an upper exterior area. Each triangular planar member is disposed atop the legs of the triangular flat base, so that each planar member and the triangular flat base intersect at a ninety degree triherdral corner. Each planar member has an adjustable panel with adjustable serrated teeth. A plurality of hooks and notches disposed on each of the panels is attachable to a top bedsheet and a bottom bedsheet.

1 Claim, 5 Drawing Sheets

BEDSHEET ANCHOR SYSTEM

BACKGROUND OF THE INVENTION

Various types of bedsheet holders are known in the prior art. However, what has been needed is a bedsheet anchor system including a triangular flat base with two legs, a curved hypotenus leg, a top surface area, and a bottom surface area. What has futher been needed is a strap knob on the bottom surface area of the triangular flat base so that an elastic strap can connect bedsheet anchors placed on each of the four corners of a bed. What also has been needed is a pair of triangular planar members, with each of the pair having an exterior area and an adjustable panel with adjustable serrated teeth. Each of the pair of triangular planar members is affixed to the legs of the triangular flat base. What has finally been needed is a series of notches and hooks on each triangular planar member that hold in place a top bedsheet and bottom bedsheet. The bedsheet anchor system is thus uniquely structured to not only better secure an edge of a bedsheet to a bed, but to prevent the tearing of the bedsheet during the securement process.

FIELD OF THE INVENTION

The present invention relates to bedsheet holders, and more particularly, to a bedsheet anchor system.

SUMMARY OF THE INVENTION

The general purpose of the present bedsheet anchor system, described subsequently in greater detail, is to provide a bedsheet anchor system that has many novel features that result in a bedsheet anchor system which is not anticipated, rendered obvious, suggested, or even implied by prior art, either alone or in combination thereof.

To accomplish this, the present bedsheet anchor system includes a triangular flat base having a left leg, a right leg, a curved hypotenus leg, a top surface area, and a bottom surface area. A strap knob is disposed on the bottom surface area of the triangular flat base for which an elastic strap connects each bedsheet anchor disposed on each corner of a bed. Each of a left planar member and a right planar member of a pair of triangular planar members has a bottom leg, a side leg, a curved leg, an interior area, a lower exterior area, and an upper exterior area. The bottom leg of the left planar member is affixed to the left leg of the triangular flat base, the bottom leg of the right planar member is affixed to the right leg of the triangular flat base, and each of the side leg of the left planar member, the side leg of the right planar member and the triangular flat base intersect one another at a ninety degree triherdral corner. It is envisioned that each of a plurality of triangular flat bases is inserted to fit on each of the four corners of a bed mattress.

A left rectangular adjustable panel with adjustable serrated teeth is on the interior surface area of the left planar member, and a right rectangular adjustable panel with adjustable serrated teeth is on the interior surface area of the right planar member. A plurality of hooks is disposed on the lower exterior area of the left planar member. Each of the plurality of hooks is attachable to a top bed sheet on a bed. A plurality of hooks is disposed on the upper exterior area of the left planar member, with each of the plurality of hooks attachable to a bottom bed sheet on a bed. A plurality of notches is disposed on each of the upper exterior area of the right planar member and the lower exterior area of the right planar member, with each of the plurality of notches attachable to each of a top bed sheet and the bottom bed sheet on the bed.

Thus has been broadly outlined the more important features of the bedsheet anchor system so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
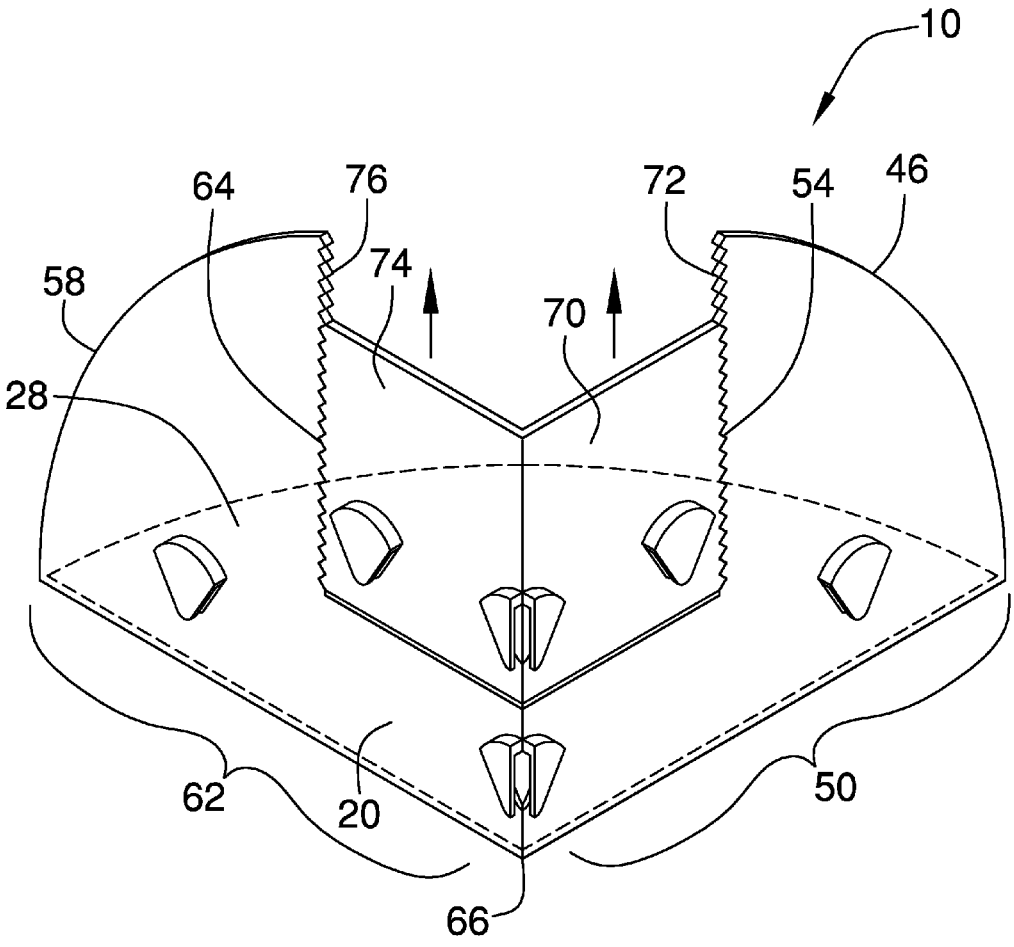
FIG. 1 is a front isometric view.
Figure 2:
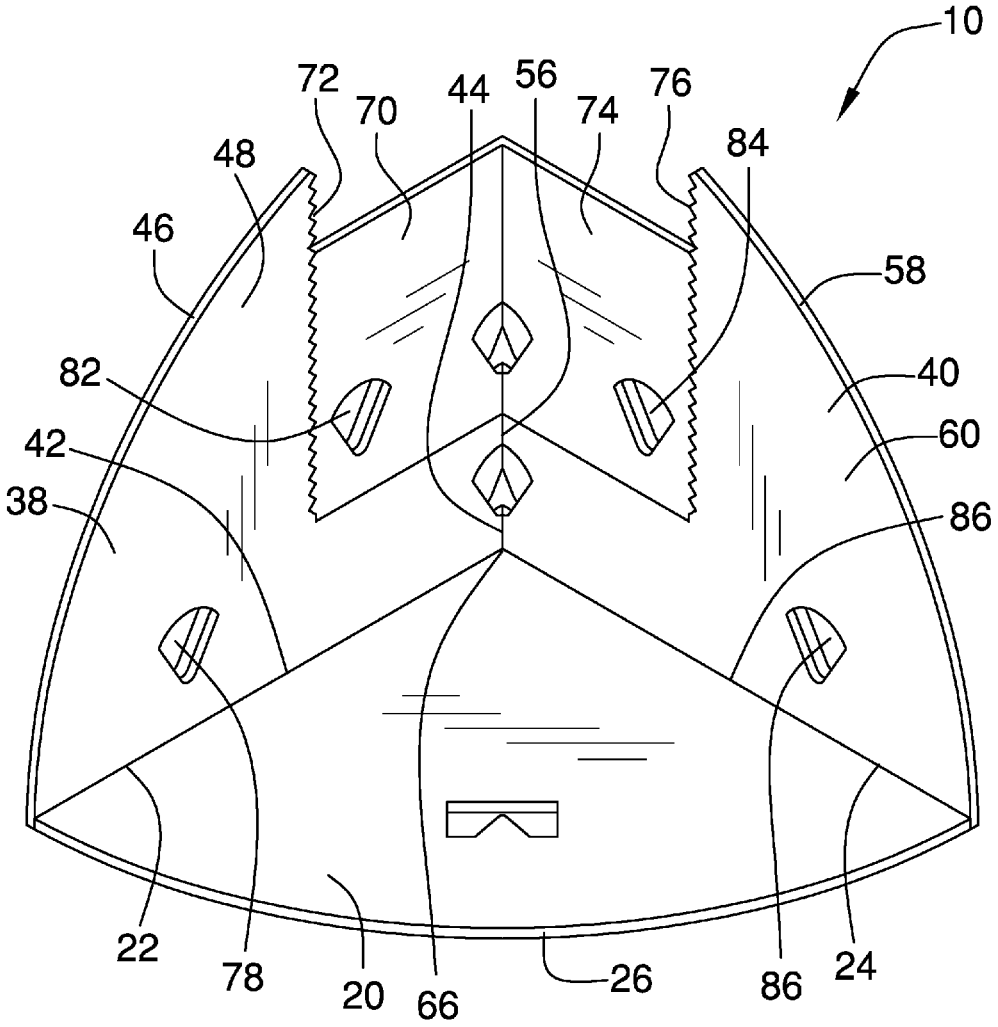
FIG. 2 is a rear isometric view.
Figure 3:
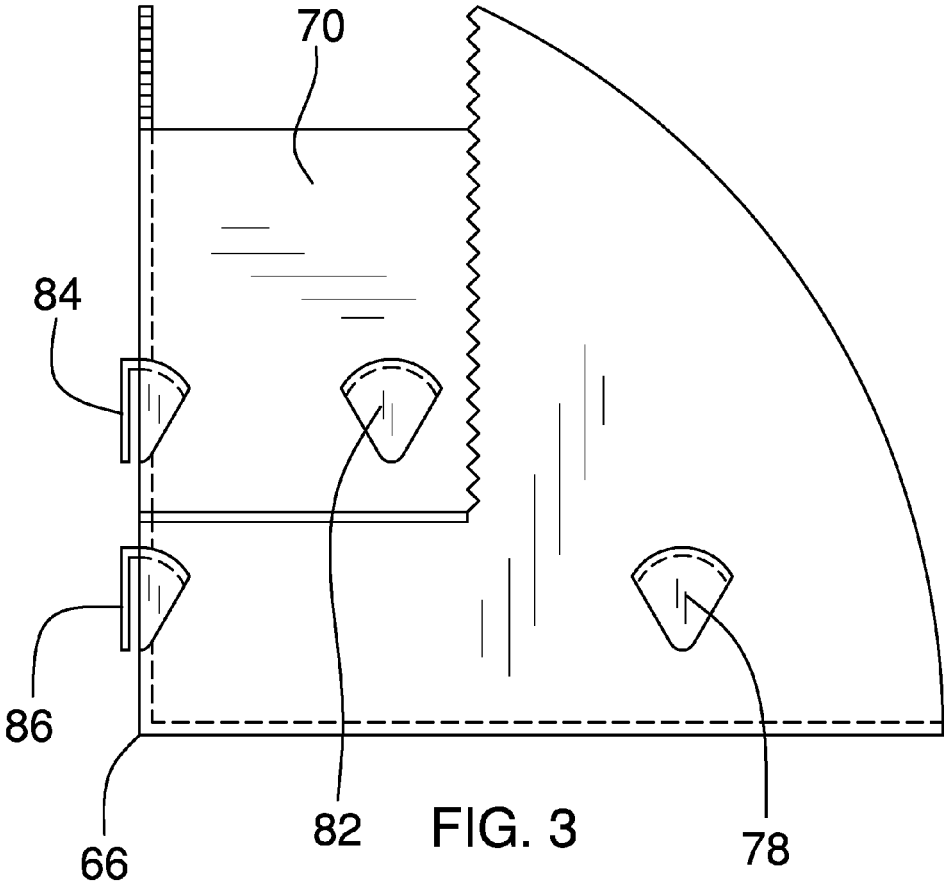
FIG. 3 is a side view.
Figure 4:
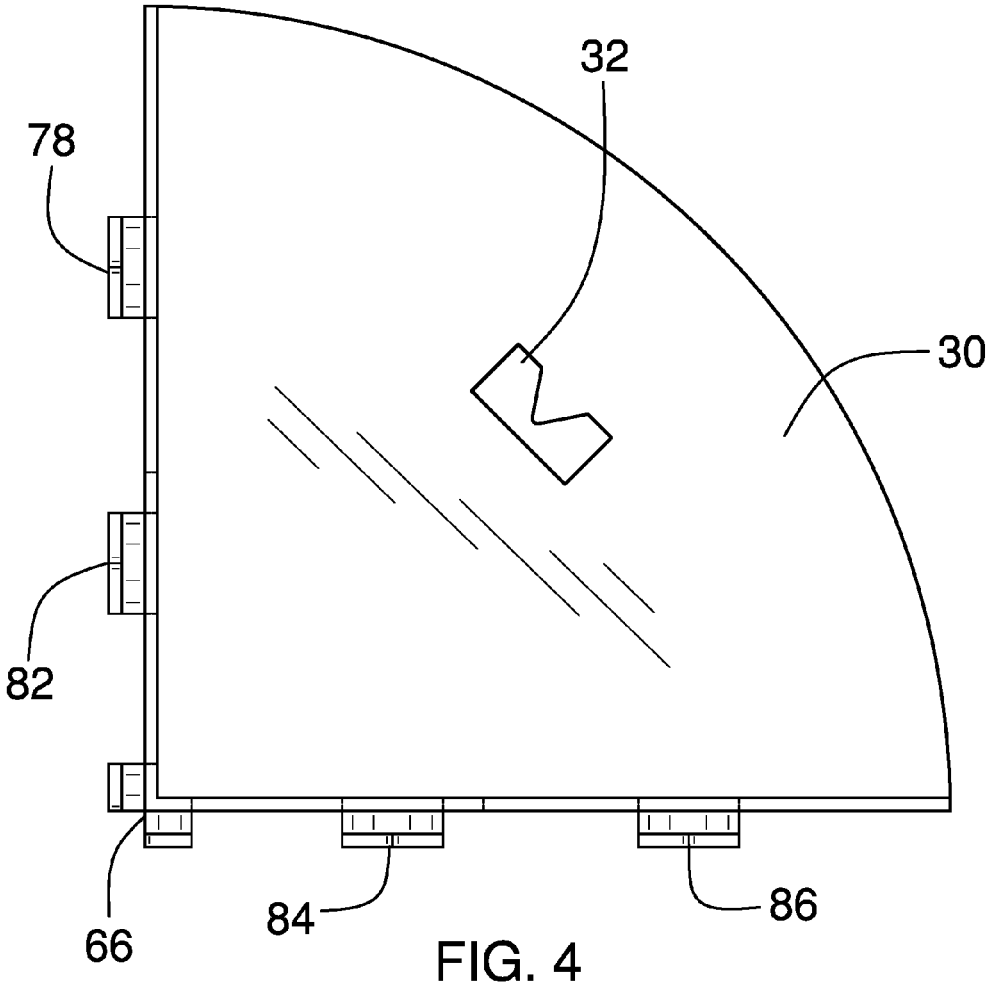
FIG. 4 is a bottom view.
Figure 5:
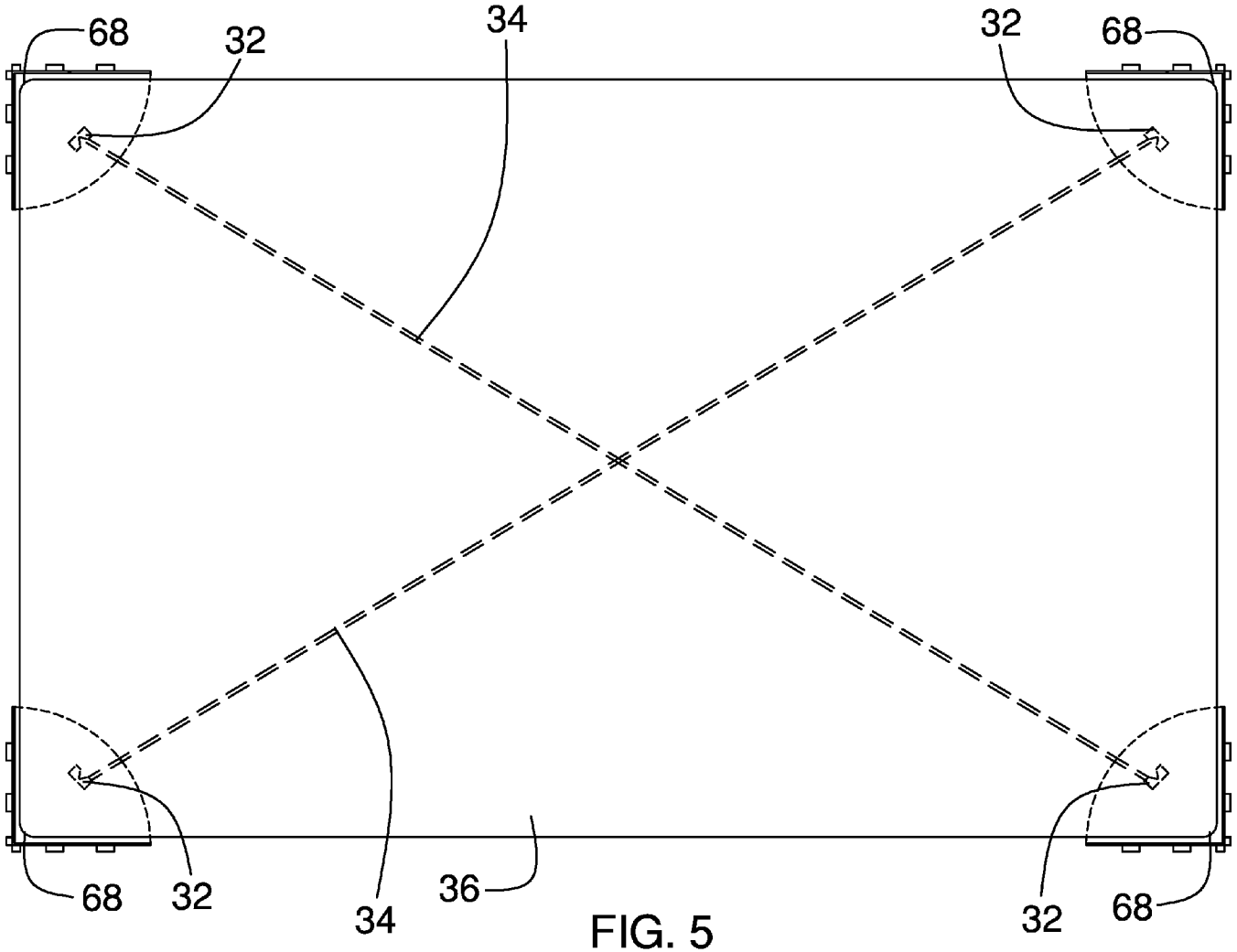
FIG. 5 is an in use view.

With reference now to the drawings, and in particular FIGS. 1 through 5 thereof, an example of the bedsheet anchor system employing the principles and concepts of the present bedsheet anchor system and generally designated by the reference number 10 will be described.

Referring to FIGS. 1 through 5 the present bedsheet anchor system. The bedsheet anchor system 10 includes a triangular flat base 20 having a left leg 22, a right leg 24, a curved hypotenus leg 26, a top surface area 28, and a bottom surface area 30. A strap knob 32 is disposed on the bottom surface area 30 of the triangular flat base 20 so that an elastic strap 34 connects each bedsheet anchor 10 disposed on each corner of a bed 36. A pair of triangular planar members includes a left planar member 38 and a right planar member 40. The left planar member 38 has a bottom leg 42, a side leg 44, a curved leg 46, an interior area 48, a lower exterior area 50, and an upper exterior area 52. The right planar member 40 has a second bottom leg 54, a right side leg 56, a right curved leg 58, a right interior area 60, a right lower exterior area 62, and a right upper exterior area 64. The bottom leg 42 of the left planar member 38 is affixed to the left leg 22 of the triangular flat base 20, the bottom leg 54 of the right planar member 40 is affixed to the right leg 24 of the triangular flat base 20, and each of the side leg 44 of the left planar member 38, the right side leg 56 of the right planar member 40 and the triangular flat base 20 intersect one another at a ninety degree triherdral corner 66. Each of four triangular flat bases 20 is insertable on each of the four corners of a bed mattress 68.

A left rectangular adjustable panel 70 having left adjustable serrated teeth 72 is on the interior area 48 of the left planar member 38, and a right rectangular adjustable panel 74 having right adjustable serrated teeth 76 is disposed on the right interior area 60 of the right planar member 40. A plurality of lower hooks 78 is disposed on the lower exterior area 50 of the left planar member 38. Each of the plurality of lower hooks 78 is attachable to a top bed sheet 80 on the bedmattress 36. A plurality of upper hooks 82 is disposed on the upper exterior area 52 of the left planar member 38. Each of the plurality of upper hooks 82 is attachable to a bottom bedsheet on a bedmattress 36. A plurality of upper notches 84 is disposed on the upper exterior area 64 of the right planar member 40. Each of the plurality of upper notches 84 is attachable to a top bedsheet on a bed mattress 36. A plurality of lower notches 86 is disposed on the lower exterior area 62 of the right planar member 40. Each of the plurality of lower notches is attachable to the bottom bed sheet on a bed mattress 36.

What is claimed is:

1. A bedsheet anchor system comprising:

a triangular flat base having a left leg, a right leg, a curved hypotenus leg, a top surface area, and a bottom surface area, wherein a strap knob is disposed on the bottom surface area of the triangular flat base;

a pair of triangular planar members comprising a left planar member and a right planar member, each of the left planar member and the right planar member having a bottom leg, a side leg, a curved leg, an interior area, a lower exterior area, and an upper exterior area, wherein the bottom leg of the left planar member is disposed atop the left leg of the triangular flat base, the bottom leg of the right planar member is disposed atop the right leg of the triangular flat base, and each of the side leg of the left planar member, the side leg of the right planar member and the triangular flat base intersect at a ninety degree triherdral corner;

a left rectangular adjustable panel having adjustable serrated teeth, wherein the left rectangular adjustable panel is disposed on the interior surface area of the left planar member;

a right rectangular adjustable panel having adjustable serrated teeth, wherein the right rectangular adjustable panel is disposed on the interior surface area of the right planar member;

a plurality of lower hooks disposed on the lower exterior area of the left planar member, wherein each of the plurality of lower hooks is attachable to a top bed sheet on a bed;

a plurality of upper hooks disposed on the upper exterior area of the left planar member, wherein each of the plurality of upper hooks is attachable to a bottom bed sheet on a bed;

a plurality of upper notches disposed on the upper exterior area of the right planar member, wherein each of the plurality of upper notches is attachable to the top bed sheet on a bed; and a plurality of lower notches disposed on the lower exterior area of the right planar member, wherein each of the plurality of lower notches is attachable to the bottom bed sheet on a bed.

* * * * *